US005125867A

United States Patent [19]

Solomon

[11] Patent Number: 5,125,867

[45] Date of Patent: Jun. 30, 1992

[54] TOY BLOCKS MADE OF FOLDED MATERIAL WITH ATTACHED PROTRUSIONS

[75] Inventor: Aryeh Solomon, Tel Aviv, Israel

[73] Assignee: Buky Toys Ltd., Yavne, Israel

[21] Appl. No.: 669,663

[22] Filed: Mar. 14, 1991

[51] Int. Cl.[5] ..... A63H 33/00; A63H 33/08; E04H 12/18; E04C 3/00

[52] U.S. Cl. ..... 446/488; 446/109; 446/111; 446/128; 52/108; 52/585

[58] Field of Search ..... 52/108, 585, 586; 434/172, 403; 446/487, 488, 85, 108, 109, 111, 113, 116, 120, 121, 122, 124, 125, 127, 128

[56] References Cited

U.S. PATENT DOCUMENTS

| | | | |
|---|---|---|---|
| 184,589 | 11/1876 | Childs | 52/585 X |
| 958,557 | 5/1910 | Stiggelman | 52/584 |
| 1,000,395 | 8/1911 | Frost | 446/104 |
| 1,146,223 | 7/1915 | Wiswell | 52/715 |
| 1,237,728 | 8/1917 | Tuck | 446/85 |
| 1,996,722 | 4/1935 | Gilbert et al. | 446/122 X |
| 2,062,510 | 11/1936 | Drumpelmann | 446/116 X |
| 2,156,155 | 4/1939 | Howard | 446/113 |
| 2,236,926 | 4/1941 | Surface | 446/112 X |
| 2,751,705 | 6/1952 | Joseph | 446/85 |
| 2,862,254 | 12/1958 | Meek | 52/578 |
| 2,885,822 | 5/1959 | Onamian | 446/122 X |
| 3,368,316 | 2/1968 | Crowder | 446/109 X |
| 3,582,431 | 6/1971 | Trenovan | 446/85 |
| 3,665,669 | 5/1972 | Huber | 52/594 |
| 3,702,520 | 11/1972 | Huber et al. | 52/284 |
| 4,026,065 | 5/1977 | Dick | 446/121 |
| 4,182,072 | 1/1980 | Much | 446/115 |
| 4,209,934 | 7/1980 | Ogawa | 446/122 X |
| 4,254,574 | 3/1981 | Stock | 446/128 |
| 4,334,683 | 6/1982 | Campbell | 446/109 X |
| 4,608,799 | 9/1986 | Hasegawa | 446/112 X |
| 4,643,697 | 2/1987 | Shetter | 446/488 |
| 4,708,691 | 11/1987 | Moore | 446/488 |
| 4,833,856 | 5/1989 | Zwageman | 446/122 X |

FOREIGN PATENT DOCUMENTS

| | | | |
|---|---|---|---|
| 2005433 | 8/1971 | Fed. Rep. of Germany | 446/120 |
| 2301764 | 7/1974 | Fed. Rep. of Germany | 446/122 |
| 2707518 | 8/1977 | Fed. Rep. of Germany | 446/113 |
| 2809231 | 9/1979 | Fed. Rep. of Germany | 446/488 |
| 2901245 | 7/1980 | Fed. Rep. of Germany | 446/109 |
| 2593717 | 8/1987 | France | 446/128 |

*Primary Examiner*—Robert A. Hafer
*Assistant Examiner*—D. Neal Muir
*Attorney, Agent, or Firm*—Abelman Frayne and Schwab

[57] ABSTRACT

A toy block comprising:

sheet material folded to form a toy block having a plurality of planar surfaces.

a plurality of holes formed on at least one of the planar surfaces; and a plurality of protrusions removably retained by the folded sheet material and extending outwardly from at least one of the planar surfaces, whereby the protrusions of one block are arranged for selectable and removable interlocking interengagement with the holes of another block.

4 Claims, 4 Drawing Sheets

TOY BLOCKS MADE OF FOLDED MATERIAL WITH ATTACHED PROTRUSIONS

FIELD OF THE INVENTION

The present invention relates to toy building blocks formed of folded sheet material.

BACKGROUND OF THE INVENTION

There are known various types of toy building blocks formed of folded sheet material. Examples of such blocks appear in U.S. Pat. Nos. 3,702,520: 3,665,669: 2,751,705 and 1,237,728. U.S. Pat. No. 4,608,799 described a building block system in which hollow blocks formed of corrugated cardboard, for example, have top edge openings receiving inverted U-shaped connectors for joining successive blocks together in a row or course and end slots together with top center slots receiving T-shaped connectors that include locking means for joining stacked rows or courses together.

The present invention seeks to provide an improved toy block formed of folded sheet material.

There is thus provided in accordance with a preferred embodiment of the invention a toy block comprising:

sheet material folded to form a toy block having a plurality of planar surfaces, a plurality of holes formed on at least one of the planar surfaces; and a plurality of protrusions removably retained by the folded sheet material and extending outwardly from at least one of the planar surfaces, whereby the protrusions of one block are arranged for selectable and removable interlocking interengagement with the holes of another block.

Additionally in accordance with a preferred embodiment of the present invention, the protrusions are provided with flanges which are retained between adjacent folded surfaces of sheet material forming the block.

There is also provided in accordance with a preferred embodiment of the invention a toy block comprising:

sheet material folded to form a toy block having a plurality of planar surfaces, said sheet material being perforated to define holes at at least first, second and third locations thereon;

said sheet material being folded such that said holes at said first location and said holes at said second location overlap in registration at a first planar surface of said block, thereby defining holes extending from the exterior to the interior of said block;

said sheet material being folded such that the holes at said third location overlap sheet material at a forth location;

protrusion means extending outwardly through said holes at said third location and being retained between the sheet material at said third location and said sheet material at said fourth location, whereby mating engagement between the protrusion means of one block and the holes defined by holes extending through the block at said first and second locations is provided.

Preferably, the holes are generally circular and the protrusions are generally cylindrical, having a flange adjacent one end thereof for being retained within the folded block.

BRIEF DESCRIPTION OF THE DRAWING

The present invention will be understood and appreciated more fully from the following detailed description, taken in conjunction with the drawings in which.

DETAILED DESCRIPTION OF A PREFERRED EMBODIMENT

Reference is now made to FIGS. 1–4 which illustrate the construction of a toy building block according to a preferred embodiment of the invention. The building block is preferably formed of a foldable relatively rigid sheet material, such as two-ply corrugated carboard 10, employing either a paper or plastic substrate.

Figure 1:
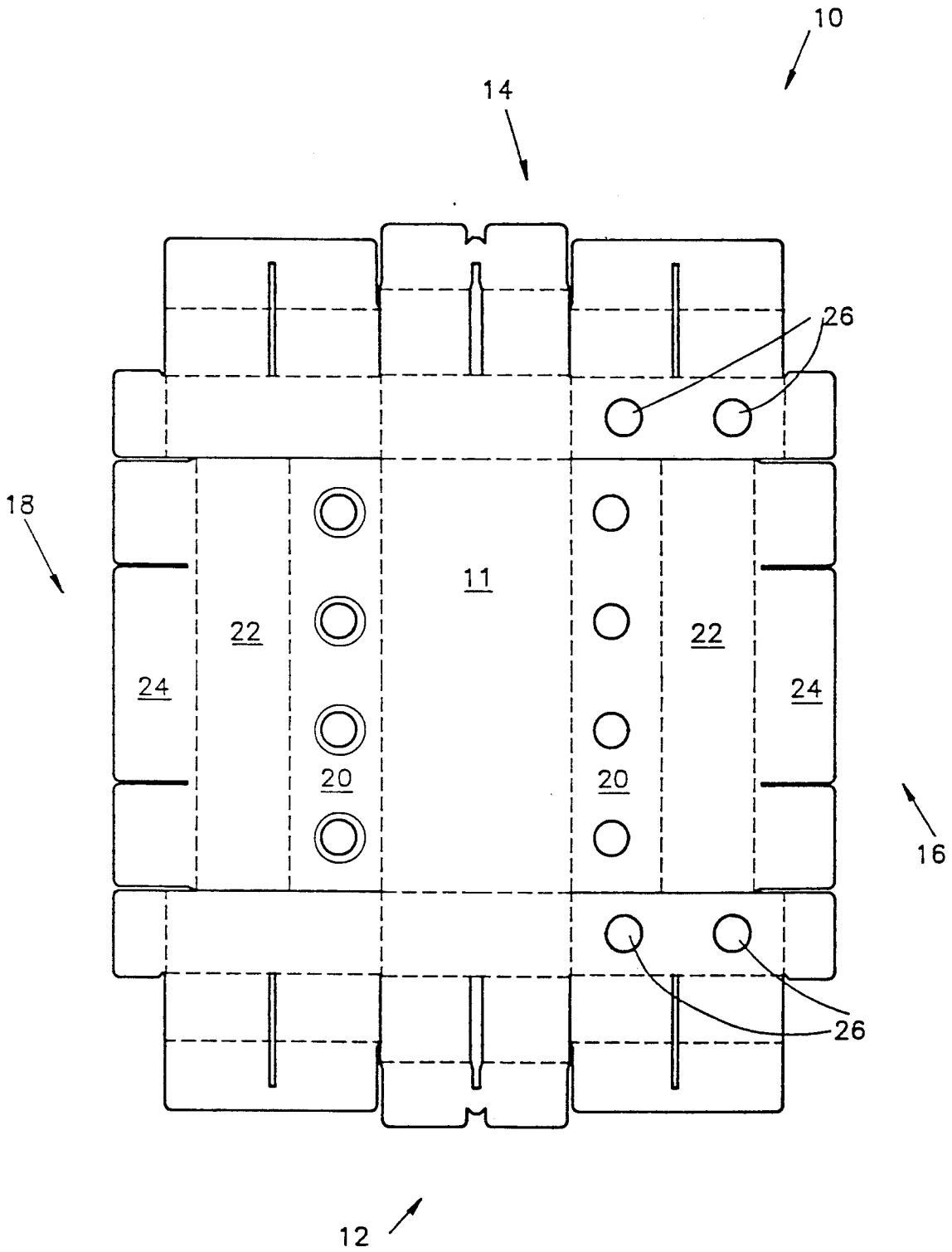
FIG. 1 is a typical blank from which a folded building block may be constructed by folding.

A typical blank is illustrated in FIG. 1, it being appreciated that the invention is not limited to this or any other given blank. In the illustrated embodiment, the blank defines a base portion 11, which defines one face of the block and internal foldable surfaces generally indicated by reference numerals 12 and 14, whose function it is to provide the block with internal strength against crushing.

The blank 10 also includes outer foldable surfaces generally identified by reference numerals 16 and 18, which define most of the outer surface of the block. Each of the outer foldable surfaces 16 and 18 preferably comprises a side edge portion 20, a half-top portion 22 and an internal flap portion 24. It is noted that the side edge portion 20 and at least some of the internal foldable surfaces 12 and 14 are formed with apertures 26, preferably of circular configuration.

Figure 2:
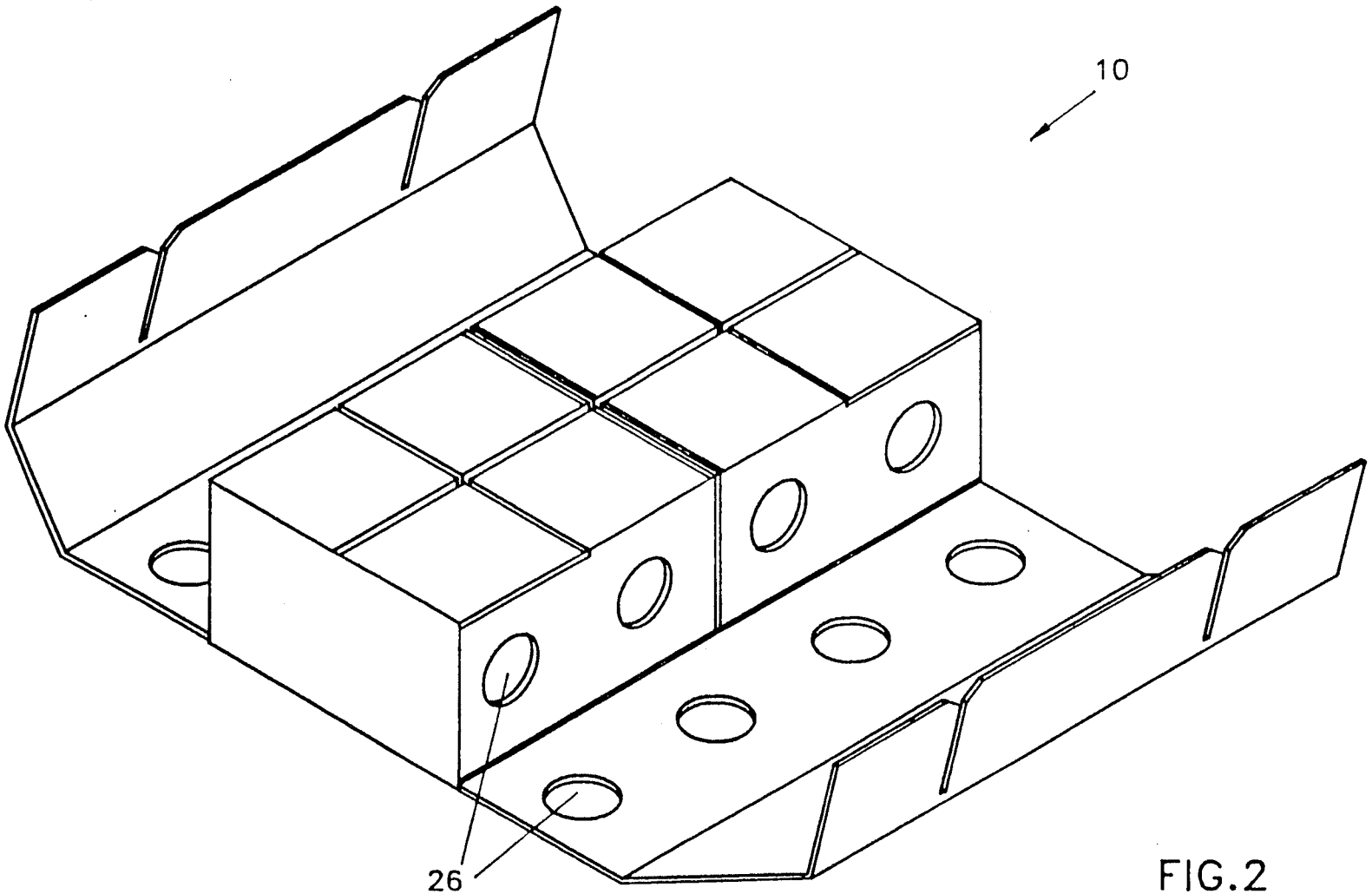
FIG. 2 is an illustration of the blank of FIG. 1 in partially folded orientation.
Figure 3:
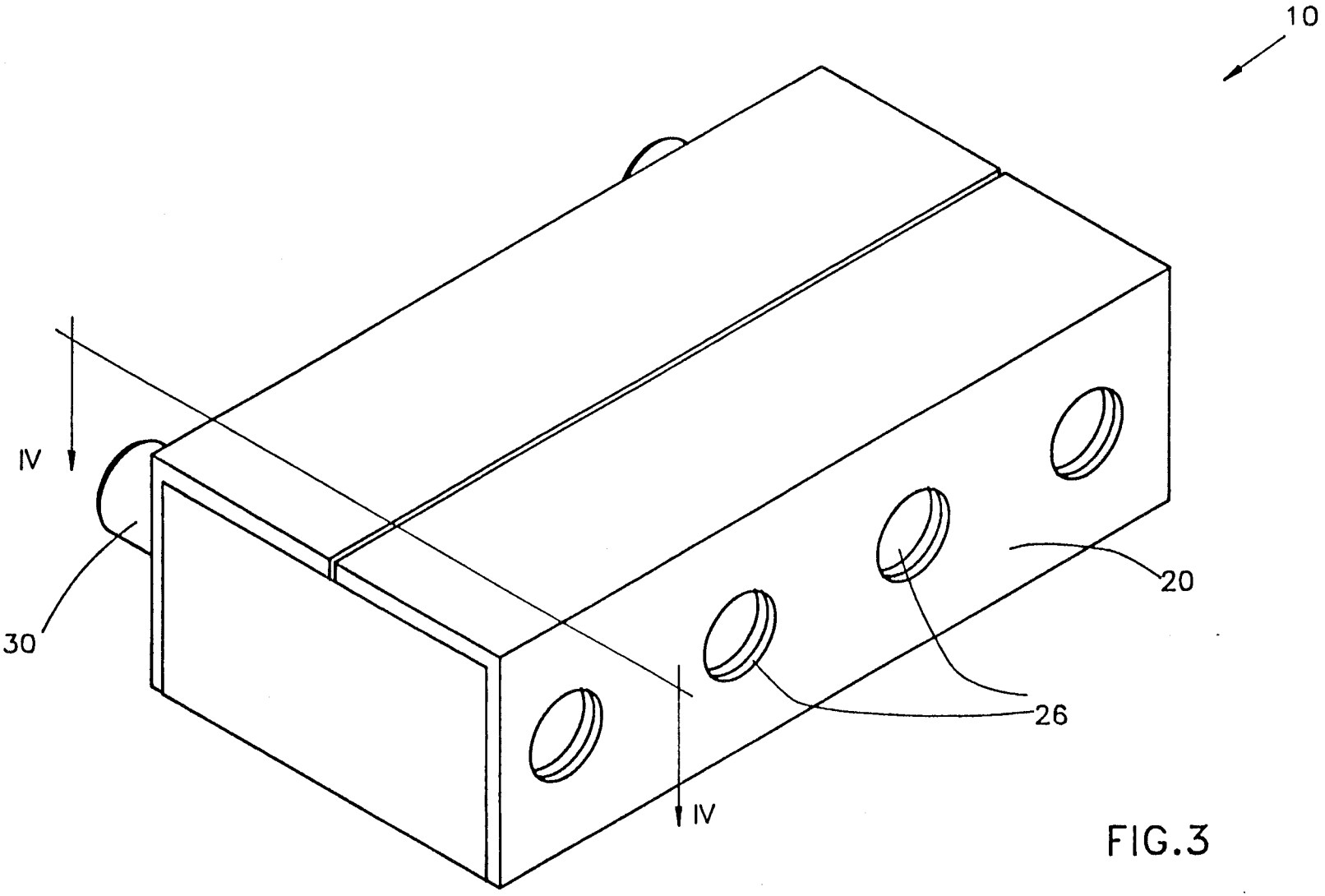
FIG. 3 is an illustration of the blank of FIGS. 1 and 2 in fully folded orientation with associated removably retained protrusion members, defining a building block constructed and operative in accordance with a preferred embodiment of the present invention.
Figure 4:
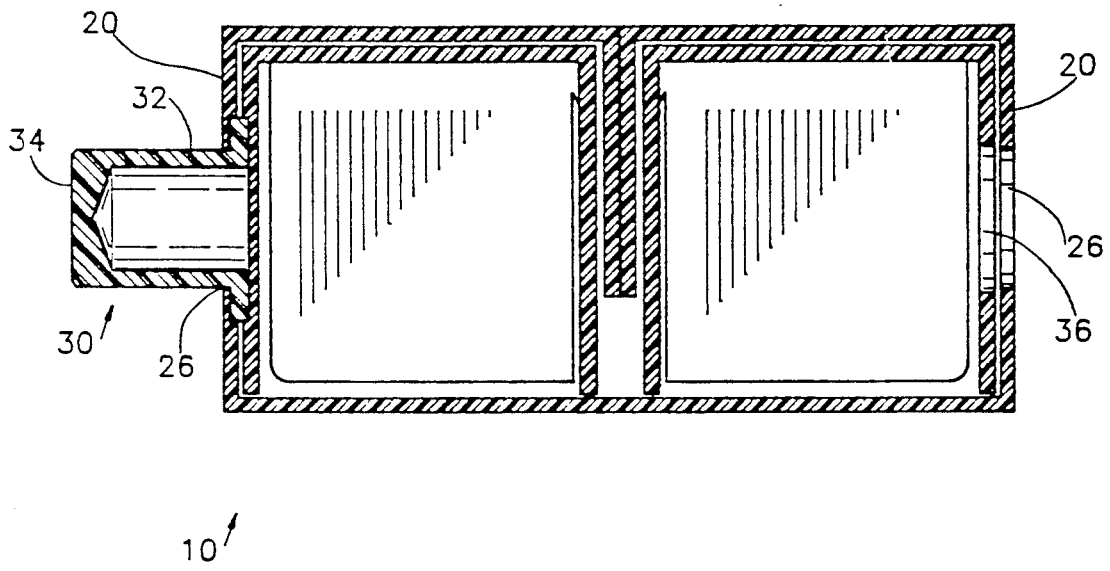
FIG. 4 is a sectional illustration, taken along the lines IV—IV in FIG. 3, illustrating the retention of protrusion members within the folded block.

Reference is now made to FIG. 2, which illustrates the blank 10 in a partially folded orientation and wherein the juxtaposition of the apertures 26 in the various surfaces can be at least partially seen. FIGS. 3 and 4 illustrate the completed block, including protrusion members 30 removably retained in some of the apertures 26 formed in the side edge portion 20.

In accordance with a preferred embodiment of the present invention, the protrusion members define a generally cylindrical portion 32 and a circular flange 34 thereabout, which is disposed adjacent one end of the cylinder. Preferably the protrusion members 30 are injection molded of plastic and are hollow, having an open end adjacent the flange 34.

In accordance with a preferred embodiment of the invention, the protrusion members 30 extend outwardly of the side edge portion 20 and are retained against retraction into the block by cooperation of the flange 34 and a part of the internal foldable surfaces 12 and 14, which, when the blank is folded into a block, lie parallel to and interior of the side edge portion 20.

It is to be appreciated that the protrusion members 30 may be engaged with any of the apertures 26 in side edge portion 20. The protrusion members 30 may be inserted into engagement or removed from engagement with apertures 26 merely by partially unfolding the block to the orientation of FIG. 2.

It is noted that juxtaposition and registration of apertures 26 in the side edge portion 20 and in the internal foldable surfaces 12 and 14 define holes 36 which are configured to receive the protrusion members 30 of another block, thereby providing removable interlocking engagement therebetween. Such removable interlocking engagement greatly enhances the play value and versatility of the blocks.

It will be appreciated by persons skilled in the art that the present invention is not limited by what has been particularly shown and described hereinabove. Rather the scope of the present invention is defined only by the claims which follow:

I claim:

1. A toy block comprising:

sheet material folded to form a toy block having a plurality of planar surfaces which together define an interior and an exterior of the block;

said sheet material being perforated to define holes at at least first, second and third locations thereon;

said sheet material being folded such that said holes at said first location and said holes at said second location overlap in registration at a first planar surface of said block, thereby defining holes extending from the exterior to the interior of said block;

said sheet material being folded such that the holes at said third location overlap sheet material at a forth location;

protrusion means extending outwardly through said holes at said third location and being retained between the sheet material at said third location and said sheet material at said fourth location, whereby mating engagement between the protrusion means of one block and the holes defined by holes extending through the block at said first and second locations is provided.

2. A toy block according to claim 1 and wherein said holes are generally circular and the protrusion means are generally cylindrical, having a flange adjacent one end thereof for being removably retained within the folded block.

3. A toy block according to claim 1 and wherein said protrusion means comprise injection molded means.

4. A toy block according to claim 1 and wherein said sheet material comprises corrugated sheet material.

* * * * *